United States Patent [19]

Siebert

[11] Patent Number: 4,969,396

[45] Date of Patent: Nov. 13, 1990

[54] ARMING ARRANGEMENT WITH ROTATABLE AIRFOILS

[75] Inventor: Rainer Siebert, Rothenbach, Fed. Rep. of Germany

[73] Assignee: Diehl GmbH & Co., Nuremberg, Fed. Rep. of Germany

[21] Appl. No.: 416,591

[22] Filed: Oct. 3, 1989

[30] Foreign Application Priority Data

Oct. 11, 1988 [DE] Fed. Rep. of Germany ..... 3834556

[51] Int. Cl.[5] ..... F42B 15/00; G01P 3/36

[52] U.S. Cl. ..... 102/225; 102/221

[58] Field of Search ..... 102/221, 225, 226, 227, 102/228

[56] References Cited

U.S. PATENT DOCUMENTS

| | | | |
|---|---|---|---|
| 3,677,186 | 7/1972 | Munach | 102/225 |
| 4,188,885 | 2/1980 | Wolf et al. | 102/221 |
| 4,848,234 | 7/1989 | Farace et al. | 102/221 |

*Primary Examiner*—David H. Brown

*Attorney, Agent, or Firm*—Scully, Scott, Murphy & Presser

[57] ABSTRACT

An arming arrangement with rotatable airfoils or blades of a propeller constituting the deliverants for an arming criterium. The blades of the driving propeller for a drone, have the rotational movement thereof determined from the tail end of the drone towards one side of the propeller hub through a beam or radiation coupling and is then conducted to a counting evaluating circuit for the derivation of a release signal for the arming device.

6 Claims, 1 Drawing Sheet

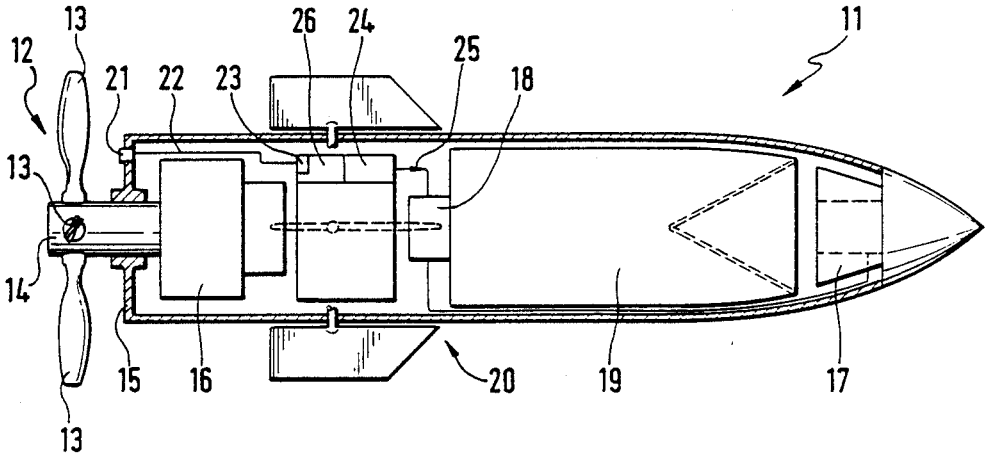
13
12
21
22
23
26
24
25
18
11
13
14
15
16
20
19
17
13

ARMING ARRANGEMENT WITH ROTATABLE AIRFOILS

BACKGROUND OF THE INVENTION

1. Field of the Invention

The present invention relates to an arming arrangement with rotatable airfoils or blades of a propeller constituting the deliverants for an arming criterium.

2. Discussion of the Prior Art

An arming arrangement of the type which is under consideration herein serves as a safety device for a firing or launching tube, inasmuch as the triggering actuation is only initiated when a projectile which is equipped with an arrangement of that kind has found itself in free flight for a sufficiently lengthy period of time; in effect, when the rotary or reversible airfoil has been sufficiently often or, in essence, rapidly set into rotation by the surrounding flow. This rotational movement which is dependent upon the incident flow can be employed for the heating of a latching element which changes in its geometry in dependent upon the heating; for example, as is disclosed in German Patent No. 31 26 288; or, however, also for the rotary generator-like generation of electrical energy for the release of a security circuit or for the charging up of an energy accumulator for a trigger circuit; for example, as is disclosed in German Laid-Open patent appln. No. 33 17 376.

SUMMARY OF THE INVENTION

Accordingly, it is an object of the present invention to provide an arming arrangement of the above-mentioned type which is especially suited for utilization in an unmanned miniaturized aircraft, hereinafter designated as a drone. Even for a projectile of that type there must be afforded some kind of safety for the launching tube; in essence, to provide a time interval commencing from the launching of the drone up to the reaching of free flight conditions at a safe distance from the launching installation.

The foregoing object is inventively attained though the provision of an arming arrangement of the type which is considered herein in that the rotary airfoils pertain to the blades of a driving propeller for a drone, the rotational movement of which is determined from the tail end of the drone towards one side of the propeller hub through a beam or radiation coupling and is then conducted to a counting evaluating circuit for the derivation of a release signal for the arming device.

The basic concept of the inventive object is thus predicated on the aspect that, as an arming criterium, there can be employed the rotational movement of rotary airfoils in the form of propeller blades which are already available for the propulsion of the drone. In any event, because of the requirement to transmit driving energy to the propeller, in the region of the support for the propeller hub and the driving components which are arranged ahead, there is no availability of installation space for a friction element or for an electric generator as deliverants of arming criteria, quite independently of the adverse influence over the power rating which would be encountered through the propeller hub during the driving of such additional power consumers. On the other hand, because of reasons of the electromagnetic degree of efficiency, there would be a lesser promise of success to arrange a generator-stator at a radial distance from the axis of the hub at the tail end of the drone, and to equip the propeller blades with ferromagnetic components, which could serve as rotors relative to the stator; inasmuch as due to constructive and especially aerodynamic reasons, the distance between the tail end of the drone and the propeller blades (in effect, the rotary airfoils within the context of the present constructional terminology) is too large in order to be able to allow for an expectation of an adequate dynamo-electric effect for an arming sequence. Moreover, the electromagnetic stator-rotor coupling would again lead to the imposition of an undesirable additional load on the drive motor for the propeller. Consequently, pursuant to the inventive object, it is contemplated that the rotation of the propeller is to be determined optronically and the arming criteria for the launching tube is derived therefrom. This is because the characteristic of an optronic receiver which is mounted on the tail end of the drone is adequately influenced by the rotor blades which are revolving in front thereof, hereby without any energy-distorting radiation phenomena, in order to modulate the radiation which is effected in reflection or in passive operation (within the visible or invisible spectral range).

This pulse-like modulation can be counted out in order to be able to derive the emitting of the arming criterium from a pulse sequence of a frequency which is predetermined by the aerodynamic propulsion technology. Hereby, the optronic transducer, in conformance with the spatial installation capabilities, can be arranged directly on the tail end of the drone, or connected therewith through a radiation or beam coupler.

BRIEF DESCRIPTION OF THE DRAWING

Additional alternatives and modifications, as well as further features and advantages of the invention can now be readily ascertained from the following detailed description, taken in conjunction with the accompanying single figure of drawing illustrating, in a generally diagrammatic longitudinal section, a propeller-driven drone with an arming arrangement which is actuated in dependence upon the rotational movement of propeller or blades.

DETAILED DESCRIPTION

The drone 11 which is illustrated in the drawing (compare, for example, with the disclosure of British Published Appln. No. 2 179 125 or the publication SOLDAT UND TECHNIK 8/1988, page 457, picture 7) represents an unmanned miniature aircraft, whose traveling movement is implemented, for example, subsequent to a catapult-like or rocket-like launch, by means of a propeller 12. The propeller blades or rotary airfoils 13 of the propeller are mounted on a hub 14 which is supported in the tail end 15 of the drone, and whereby the propeller is set into rotation by a motor 16.

A circuit or sensor circuit controls the delivery of articles of submunition; or a trigger sensor 17 such as a proximity or impact sensor arranged in the front region of the drone 11 causes an active charge 19 of the drone to be set into detonation at a specific time through the action of a fuze 18; but specifically first only after travel for a sufficiently safe distance from the launching installation for the drone (not shown); in essence, when the traveling movement of the drone 11 is no longer carried by the launch accelerating mechanism, but has been effected for a sufficiently lengthy period of time through the action of the propeller 12.

An arming arrangement 20 is provided for this purpose, which will only first release upon the activation of the fuze 18 by the (trigger sensor 17) after the propeller 12 has rotated for a sufficiently lengthy period of time and rapidly enough. This is detected, for example, by means of an optronic receiver 21 which is oriented from the tail end 15 of the drone somewhat axially parallel towards the path of movement of the rotating airfoils or blades 13 of the propeller. When the receiver 21 operates as an active light receiver, it is designed as a transmitter-receiver, and the rotary airfoils 13 act as reflectors which periodically cross the path of the beam. With the design in the form of a passive receiver 21, the rotary blades 13 serve as shutters for the periodic shading (modulation) of the ambient radiation from the surroundings striking against the receiver. For a receiver 21 which is designed to be responsive to the thermal radiation spectrum, the propeller blade edges which are heated in the course of flight operation serve as rotating IR-irradiators. Because of reasons of space limitations, it can be expedient to construct the receiver 21 which is arranged at the tail end 15 to conduct the incident and, respectively, reflective radiation through the cross-sectional surface of a radiation conductor 22, and to locate the actual, for instance, optronic transducer 23 in the interior of the drone 11, somewhere near the region of the energy supply and the drive control.

The arming arrangement 20 contains an evaluating circuit 24 which will only arm the fuze 18 when the propeller 12 has rotated for a sufficiently lengthy period of time; in effect, the evaluating circuit 24 can be essentially constructed as a counting circuit for the pulses which are delivered from the rotating propeller blades 13 and which are, for example, optronically converted, and which upon the attainment of a specified final count condition, will deliver a releasing signal 25 to the fuze 18.

In order to increase the safety for the launching tube which is afforded through this arming arrangement, the input of the pulse counting evaluating circuit 24 can be connected to the output of circuit 26 which, for example, will only allow for the passage of pulse sequences to the evaluating circuit 24 which are above a certain threshold frequency. The foregoing will provide that there is effected the addition of only pulses for the arming, which result from the rotational working speed of the propeller 12, whereas the appearance of any pulses during the interval of time in which the propeller 12 is yet at a standstill or is first approaching the work speed, will be masked out.

What is claimed is:

1. Arming arrangement with rotary airfoils constituting deliverants of an arming criterium, said rotary airfoils comprise the rotary blades of a driving propeller for a drone; means for detecting the rotational movement of said blades of the driving propeller for the drone at one side of the hub of said propeller through a radiation coupling; and a counting evaluating circuit having the output of said detecting means coupled as an input thereto for the derivation of a releasing signal to said arming arrangement.

2. Arming arrangement as claimed in claim 1, including a filter circuit to allow the passage of pulses above a threshold frequency such that a rotational speed frequency evaluation is effected in said arrangement.

3. Arming arrangement as claimed in claim 1, wherein said detecting means includes a transmitting conductor extending between a receiver arranged on the tail end of said drone at which said driving propeller is located and a transducer arranged within said drone.

4. Arming arrangement as claimed in claim 1, wherein the rotary blades of the propeller comprise reflectors for an active radiation transducer including a radiation transmitter and a radiation receiver.

5. Arming arrangement as claimed in claim 1, wherein the rotary blades of the propeller comprise shutters for a passive radiation receiver of said detecting means which detects ambient radiation from the surroundings.

6. Arming arrangement as claimed in claim 1, wherein said detecting means including a passive thermal receiver which detects thermal radiation emitted by the heated edges of the rotary blades of the propeller.

* * * * *